US005592983A

United States Patent [19]

Sartini et al.

[11] Patent Number: 5,592,983

[45] Date of Patent: Jan. 14, 1997

[54] PULL CORD SAFETY DEVICE

[75] Inventors: Eugene Sartini, Fall River, Mass.; Dannie L. McMichael, West Kingston, R.I.

[73] Assignee: Kenney Manufacturing Company, Warwick, R.I.

[21] Appl. No.: 389,278

[22] Filed: Feb. 9, 1995

[51] Int. Cl.[6] ..... E06B 9/38

[52] U.S. Cl. ..... 160/178.1; 16/122; 24/115 F

[58] Field of Search ..... 160/178.1, 320, 160/173, 176.1, 168.1; 24/716, 706.1, 115 K, 115 F, 115 H; 16/225, 114 R, 114 B, 122, DIG. 12, DIG. 18, DIG. 19, DIG. 13, DIG. 24, DIG. 25

[56] References Cited

U.S. PATENT DOCUMENTS

| | | | |
|---|---|---|---|
| 2,247,322 | 6/1941 | Stuber . | |
| 2,637,887 | 5/1953 | Goodman et al. . | |
| 3,108,346 | 10/1963 | Bey . | |
| 3,485,285 | 12/1969 | Anderle . | |
| 3,628,215 | 12/1971 | Everburg | 16/225 X |
| 3,727,665 | 4/1973 | Debs . | |
| 4,049,357 | 9/1977 | Hamisch | 24/115 H |
| 4,366,852 | 1/1983 | Holzer . | |
| 4,411,044 | 10/1983 | Volfson . | |
| 4,414,705 | 11/1983 | Ostrowsky | 16/225 |
| 4,477,947 | 10/1984 | Lyons . | |
| 4,635,698 | 1/1987 | Anderson . | |
| 4,782,560 | 11/1988 | Keller | 24/115 M |
| 4,821,789 | 4/1989 | Van Rens | 160/176.1 |
| 4,909,298 | 3/1990 | Langhart et al. . | |
| 5,125,447 | 6/1992 | Suggs . | |
| 5,372,510 | 12/1994 | Stanfield | 24/115 H X |
| 5,473,797 | 12/1995 | Wu | 160/178.2 R X |
| 5,504,977 | 4/1996 | Weppner et al. | 160/178.1 R X |

*Primary Examiner*—David M. Purol

*Attorney, Agent, or Firm*—Wolf, Greenfield & Sacks, P.C.

[57] ABSTRACT

A pull cord safety device has a single molded body with two members coupled by an integral hinge. The hinge allows the members to pivot from a closed position to an open position. One member receives a first knotted pull cord in a circular opening so that it is coupled to the member in both the open and closed positions. A second knotted cord is inserted in a recess formed in a rim of one member where it faces the other member. When the members move to the open position, the second cord is released. Multiple cords can be accommodated in the recess.

20 Claims, 2 Drawing Sheets

PULL CORD SAFETY DEVICE

FIELD OF THE INVENTION

This invention relates generally to a safety device for pull cords that are used with drapes or blinds, and more particularly to a safety device that prevents injury to infants.

1. Background of the Invention

Pull cords for window or door coverings, such as drapes or blinds or the like, potentially can be dangerous for small children. If the cords are connected together, or if they form a continuous loop, the cords can act as a noose for a small child if the child's head or other body part gets caught between them. This problem is particularly acute if adults fail to properly secure the cords on the window or door frame and allow them to dangle near the floor. One solution to this problem is found in U.S. Pat. No. 4,909,298 in which two pull cords are coupled to a device that has two discrete and separable halves and in which each half is connected in a fixed relationship to one of the pull cords.

2. Summary of the Invention

According to one aspect of the present invention, a pull cord device is provided which includes two members connected by a hinge. The two members pivot about the hinge for opening and closing of the device. Typically, each member is of about the same size and shape and has a rim which surrounds a hollow interior. The respective rims mate and are aligned with one another in the closed position to form a closed, hollow body. The device may be formed as a unitary body which is integrally molded from plastic, or the members may be separately formed and joined by a separate hinge. Two or more cords are used with the device, preferably extending through openings in the members. One opening is disposed in a wall in one member and the other opening is formed as a recess in one rim where the rims abut when in the closed position. One cord extends through the one opening and is knotted so that it is fixed to that one member in both the closed and the open positions. Any remaining cords extend through the other opening and also may be knotted. When a downward force is applied to the device, the members separate from each other, pivoting about the hinge. The remaining cords, other than the first cord, are released from the device so that they hang freely. The one cord remains coupled to the one member and thus to the entire device to prevent the device from being lost or swallowed. The one opening and the recess preferably are formed in different members, although they could be formed in the same member.

The hinge that couples the members preferably includes a generally L-shaped rigid spring that is coupled to a bottom wall of one member and to a side wall of the other member. The spring is connected by a flexible hinge at each end to a respective bottom wall and side wall. As the members separate by pivoting, the spring first resists movement and then, acting as a tension spring, it causes the members to snap open. The spring thus urges the members into an open or closed position, depending on the relative orientation of the first and second members with respect to one another.

In another aspect of the invention, to assist in aligning the members and locking the members together, one member includes a plurality of pins while the other member has mating channels for the pins.

The safety device according to a preferred embodiment of the present invention is easy and inexpensive to manufacture because it is a one-piece body. The device is preferably molded as a single integral body of polypropelene and can be made in one of many colors to match the decor. Because only one cord is fixed to the device, multiple cords can be accommodated. For example, if four cords are used, three of the cords extend through the second opening, and one cord is fixed to one member.

BRIEF DESCRIPTION OF THE DRAWINGS

The objects, features and advantages of this invention will be more clearly appreciated from the following detailed description when taken in conjunction with the accompanying drawings in which.

DETAILED DESCRIPTION

Figure 1:
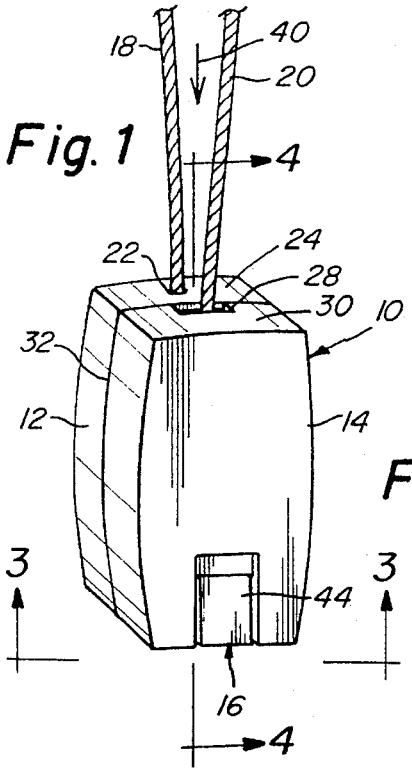
FIG. 1 is a perspective view of a pull cord safety device according to the present invention in a closed position.
Figure 2:
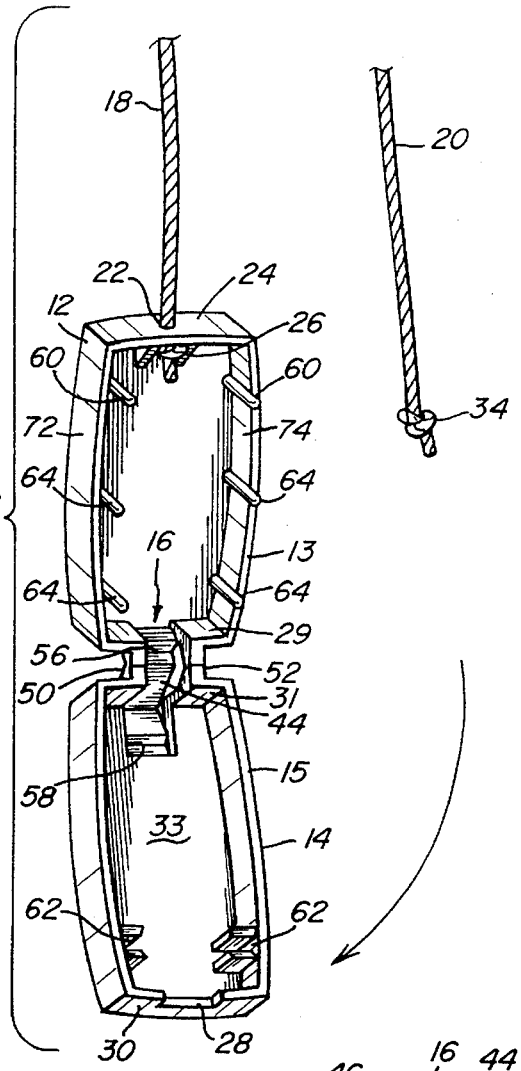
FIG. 2 is a perspective view of the pull cord safety device of FIG. 1 in an open position.

With reference now to the drawings and more particularly to FIGS. 1 and 2 thereof, a device according to one aspect of the present invention includes a body 10 that has mating first and second members 12 and 14. Members 12 and 14 have respective mating rims 13 and 15 that surround a hollow interior. Members 12 and 14 are connected by a hinge 16 which is disposed adjacent walls 29 and 31 of members 12 and 14 respectively. In a closed position (FIG. 1), rims 13 and 15 abut each other along a central break line 32, so that body 10 essentially defines a hollow container. Typically body 10 is formed of a single or unitary piece of molded plastic. However, members 12 and 14 and hinge 16 may be separately formed and subsequently attached.

Figure 4:
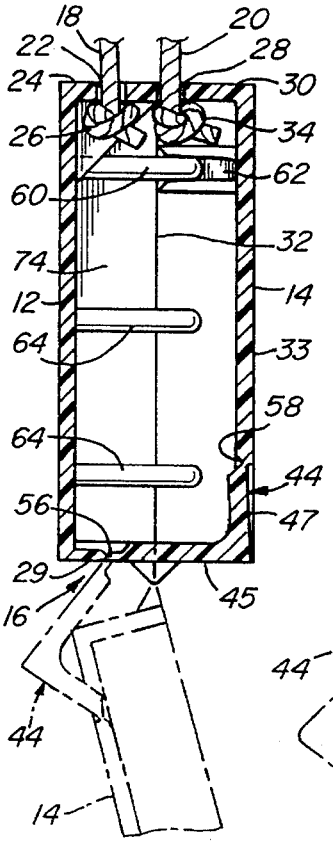
FIG. 4 is a cross-sectional view of the device of FIG. 1 taken along the line 4—4.

In the closed position, body 10 is coupled to a plurality of pull cords including at least a first cord 18 and a second cord 20. Referring in particular to FIGS. 1 and 4, first cord 18 extends through an opening 22 in a wall 24 of member 12, and is retained on wall 24 by a knot 26 in the end of cord 18 that is larger than opening 22 and is enclosed within the interior of body 10. Cord 20 extends through a recess 28 found in rim 15 in top wall 30 of member 14. Recess 28 could also be formed in rim 13 of member 12. When members 12 and 14 are in a closed position, rim 13 of member 12 provides a closing side to recess 28 to form an enclosed aperture. The end of cord 20 is also tied in a knot 34 which is larger than recess 28 and which resides within body 10 in the closed position. Walls 24 and 30 preferably are in opposed relation with walls 29 and 31 so that cords 18 and 20 are disposed directly opposite hinge 16. In the closed position, cords 18 and 20 are each connected to body 10, and together body 10 and cords 18 and 20 form a closed loop.

Referring to FIGS. 1 and 2, when a downward force (represented by arrow 40 in FIG. 1), is applied to body 10 at a location between cords 18 and 20, members 12 and 14 separate by pivoting about hinge 16 to form an angle typically less than 180° so that body 10 is in an open position as shown in FIG. 2. In this open position, cord 18 remains fixed to member 12 while cord 20 is released from body 10 and hangs freely. Thus, the closed loop is broken. Cord 20 can be easily reconnected when body 10 is again closed. The fixed connection of cord 18 to member 12 is useful because if body 10 is allowed to fall to the ground, a child might try to swallow it or it could become lost. The connection of cord 18 to member 12 also protects member 14, since it is connected by hinge 16.

Figure 6:
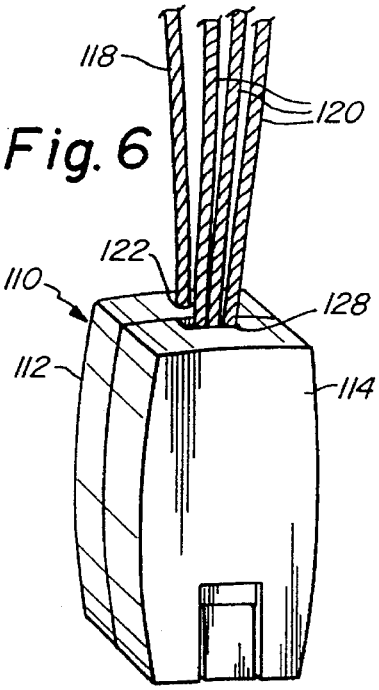
FIG. 6 is a perspective view of the device of FIG. 1 in a closed position showing four cords.
Figure 7:
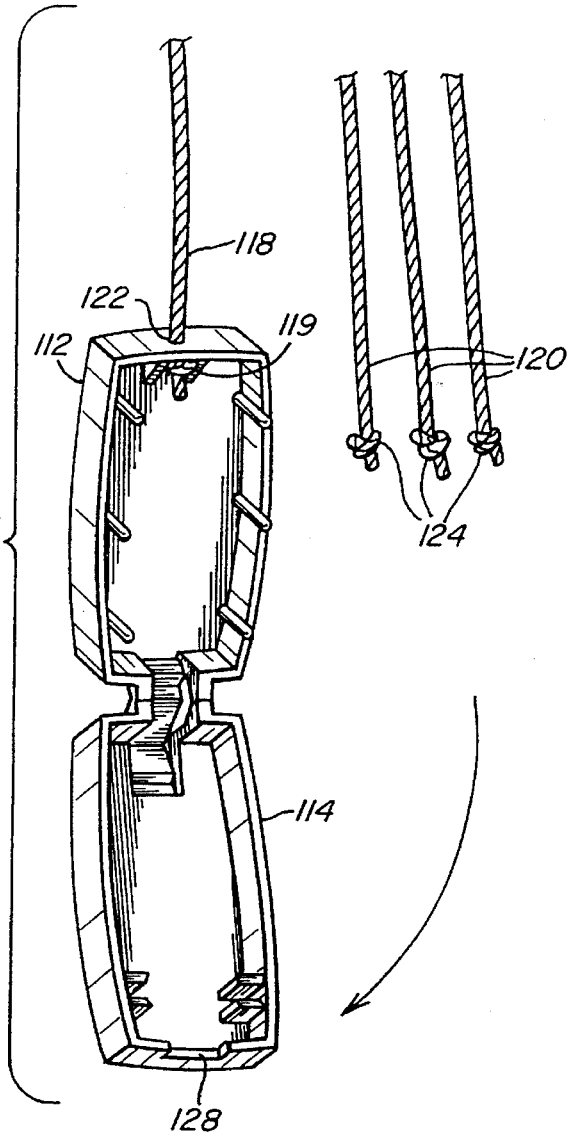
FIG. 7 is a perspective view of the device of FIG. 6 in an open position.

Referring to FIGS. 6 and 7, if more than two cords are attached to body 110, one cord 118 passes through opening 122 and is connected to member 112 by a knot 119 on the other side of opening 122 while the other cords 120 are releasably connected by extending through recess 128 in member 114 and are temporarily held in place by knots 124. Accordingly, when the device is opened, cords 120 are released while cord 118 remains attached. Thus, a single body 110 can accommodate two or more cords.

In another aspect of the invention, to guide members 12 and 14 into the closed position and to help keep them closed, pins 60 and 64 and channels 62 are provided. Typically, member 12 has two pins 60 and four pins 64. One pin 60 and two pins 64 are disposed along each of side walls 72 and 74. Each pin 60 mates with respective channel 62 formed in member 14 to guide members 12 and 14 together into a closed position and to provide a frictional force that helps keep body 10 closed. The frictional force should be sufficiently strong to help hold members 12 and 14 together, but sufficiently weak that members 12 and 14 separate when a downward force is applied. Pins 64 are used for positioning of members 12 and 14 with respect to one other and for stability, but they have no corresponding channels in member 14.

Figure 5:
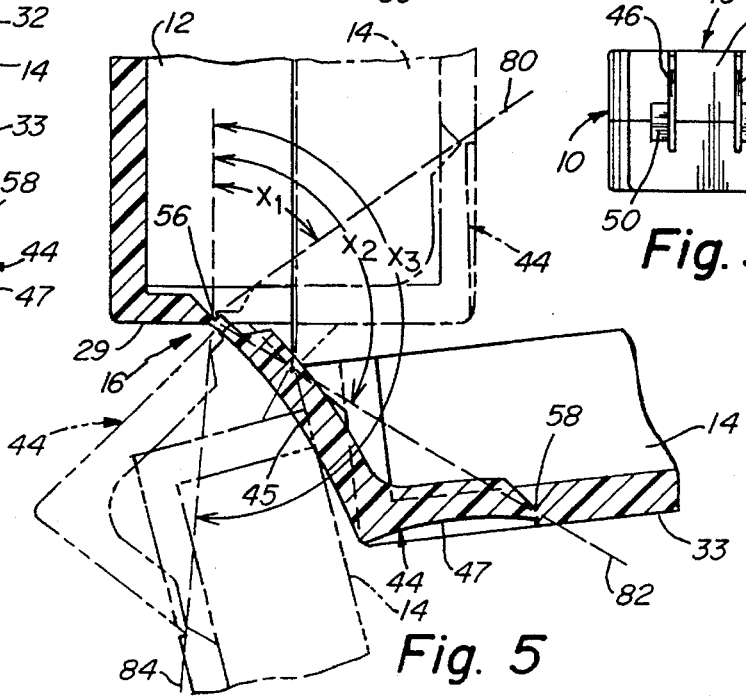
FIG. 5 is a partial cross-sectional view of a hinge of the device of FIG. 1 in various positions.
Figure 3:
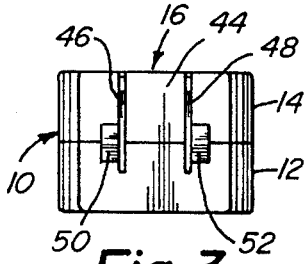
FIG. 3 is a bottom plan view of the device of FIG. 1.

Referring to FIGS. 3–5, hinge 16 preferably is integrally molded with members 12 and 14, although hinge 16 could be separately formed and attached to members 12 and 14. Hinge 16 includes a generally L-shaped spring 44 and links 50 and 52. Spring 44 is laterally positioned between links 50 and 52 and slots 46 and 48 which separate respective links 50 and 52 from spring 44. Links 50 and 52 hold members 12 and 14 together, allow members 12 and 14 to pivot open and closed, and provide lateral stability when body 10 is opened and closed.

Spring 16 includes legs 45 and 47. Leg 45 of spring 44 is attached to bottom wall 29 of member 12 and leg 47 of spring 44 is attached to side wall 33 of member 14. Grooves 56 and 58 at each end of spring 44 create flexible hinges that allow legs 45 and 47 of the spring to pivot relative to walls 29 and 33 respectively. It is apparent that other configurations of spring 16 are within the scope of this invention, as long as spring 16 provides the desired spring effect.

Operation of the device of this invention will now be described by referring particularly to FIG. 4. As member 14 is rotated relative to member 12 in a clockwise direction, members 12 and 14 are acted upon by forces from pins 60 and from spring 16. In an initial position at an angle $X_1$ between a vertical line 79 and line 80 connecting grooves 56 and 58, in which members 12 and 14 are in a closed position and where rims 13 and 15 touch, legs 45 and 47 are at an acute angle of a little less than 90° relative to each other. In this position, there is only small resistance to separation of members 12 and 14. This resistance is caused primarily by the frictional force between pin 60 and channels 62, and by spring 16. When pins 60 are just free of channels 62 at a slightly open position, and when pins 60 reside in channels 62 in a closed position, only a minimal closing force is exerted by spring 16. As members 12 and 14 pivot farther into a slightly more open position, cord 20 can be pulled out of body 10, since recess 28 is a little wider than the diameter of the cord and since knot 34 is small.

As the two members 12 and 14 separate farther and spring 16 increasingly becomes deformed so that legs 45 and 47 form an obtuse angle, the resistive force against farther separation of members 12 and 14 increases. By this time, however, members 12 and 14 are sufficiently separated so that cord 20 (and any additional cords) can be pulled from the device. Eventually, spring 16 reaches a central position at angle $X_2$ between the vertical line 79 and line 82 (FIG. 5) where the force from the spring 16 changes from a closing force to an opening force. With any further clockwise opening movement, (as shown in FIG. 5) spring 16 snaps members 12 and 14 apart until the members reach a final equilibrium position at an angle $X_3$ between vertical line 79 and line 84. When closing body 10, the snapping action of spring 16 as the members move past position 82 in the counter-clockwise direction (see FIG. 5) is generally sufficient to cause members 12 and 14 to pivot to a closed position. Notwithstanding the references to increased resistive forces, the force against separation of members 12 and 14 is never very strong.

While opening 22 preferably is a circular aperture, it can take some other shape or form such as a square or rectangular aperture. Also, member 12 could have a loop to which a cord 18 could be tied, or member 12 could employ a receptacle with an adhesive for an attachment of cord 18. While hinge 16 preferably includes an L-shaped spring, hinge 16 could simply have pivoting members without a spring. Alternatively, a spring separate and apart from hinge 16 could be utilized. Finally, recess 28 typically is rectangular in shape, but could be oval or square in shape.

In view of the above description, it is likely that modifications and improvements will occur to those skilled in the art which are within the scope of this invention. The above description is intended to be exemplary only, the scope of the invention being defined by the following claims and their equivalents.

What is claimed is:

1. A device for connection to ends of plurality of pull cords of a type used with window or door coverings, the device comprising:

a first member having a first rim;

a second member having a second rim;

a hinge coupled to both the first and second members for allowing the first and second members to pivot relative to one another about the hinge from a closed position in which the first and second rims touch to an open position wherein the first and second rims are spaced from one another;

means for fixedly connecting a first pull cord to the first member; and second means for connecting a second pull cord to the device when the device is in the closed position and for releasing the second pull cord from the device upon application of a force to the device between the first and second pull cords.

2. The device of claim 1, wherein the device is formed of a single piece of molded plastic.

3. The device of claim 1, wherein the second connecting means includes a recess formed in the second rim.

4. The device of claim 1, wherein the means for fixedly connecting includes an aperture in the first member.

5. The device of claim 1, wherein the hinge includes a spring.

6. The device of claim 5 wherein the spring urges the first and second members into a closed position when the first and second members are disposed at an angle with respect to one another less than a predetermined angle and wherein the spring urges the first and second members into an open position when the first and second members are disposed at an angle with respect to one another greater than the predetermined angle.

7. The device of claim 1, wherein the second connecting means connects a plurality of cords to the device.

8. The device of claim 1, wherein the first member includes plurality of positioning pins that extend toward and contact the second member in the closed position.

9. The device of claim 8, wherein the second member has at least one channel for receiving one of the pins in a friction fit for retaining the members in the closed position.

10. A device for use with a plurality of pull cords of a type used with window or door coverings, the pull cords including a first pull cord and a second pull cord, the device comprising:

a first member;

a second member coupled to the first member and movable with respect to the first member from a first position to a second position;

means for connecting the first pull cord to the device whereby the first pull cord is connected to the device in both the first and second positions; and means for releasably connecting the second pull cord to the device so that the second pull cord is connected to the device in the first position and automatically released from the device in the second position.

11. The device of claim 10, wherein the device is formed from a single piece of molded plastic.

12. The device of claim 10, wherein the releasably connecting means includes a recess in the second member along an edge of the second member which abuts the first member in the first position.

13. The device of claim 12, wherein the connecting means includes an aperture in the first member.

14. The device of claim 10, wherein the releasably connecting means is configured to connect a plurality of cords.

15. The device of claim 10, wherein the first member has a plurality of positioning pins extending toward and contacting the second member in the first position.

16. The device of claim 15, wherein the second member has at least one channel having a sufficient size for receiving one of the pins in a frictional fit for retaining the members in the first position.

17. An apparatus comprising:

a first pull cord;

a second pull cord;

a safety device including:

a first member;

a second member coupled to the first member and movable with respect to the first member from a first position to a second position;

means for connecting the first pull cord to the device whereby the first pull cord is connected to the device in both the first and second positions; and means for releasably connecting the second pull cord to the device so that the second pull cord is connected to the device in the first position and automatically released from the device in the second position.

18. The apparatus of claim 17, further comprising a third cord releasably connected to the releasably connecting means.

19. The apparatus of claim 18, further comprising a fourth cord releasably connected to the releasably connecting means.

20. The apparatus of claim 17, wherein the first cord is connected to the first member and wherein the second cord is disposed in a recess between the first and second members in the first position.

* * * * *